US008450932B2

(12) United States Patent
Qian et al.

(10) Patent No.: US 8,450,932 B2
(45) Date of Patent: May 28, 2013

(54) HIGH PRESSURE SODIUM LAMP

(76) Inventors: Fuqing Qian, Ontario, CA (US); Song Qian, Ontario, CA (US)

( * ) Notice: Subject to any disclaimer, the term of this patent is extended or adjusted under 35 U.S.C. 154(b) by 139 days.

(21) Appl. No.: 13/068,418

(22) Filed: May 9, 2011

(65) Prior Publication Data

US 2012/0286660 A1 Nov. 15, 2012

(51) Int. Cl.
*H01J 7/44* (2006.01)
*H01J 61/52* (2006.01)
*H01J 61/12* (2006.01)

(52) U.S. Cl.
USPC ..... 313/637; 313/633; 313/635

(58) Field of Classification Search
USPC ..... 313/633, 637
See application file for complete search history.

(56) References Cited

U.S. PATENT DOCUMENTS 4,490,642 A * 12/1984 Dobrusskin et al. ..... 313/25
2006/0290286 A1 * 12/2006 Mucklejohn et al. ..... 313/643
2009/0230867 A1 * 9/2009 Wakahata et al. ..... 313/637

* cited by examiner

*Primary Examiner* — Tracie Y Green
(74) *Attorney, Agent, or Firm* — Raymond Y. Chan; David and Raymond Patent Firm

(57) ABSTRACT

A high pressure sodium lamp includes a lamp base, a light admissible housing and a sodium vapor illumination arrangement, which includes a light core extended from the lamp base into the light admissible housing; a supporting frame, and an arc tube. The supporting frame longitudinally extends in the light admissible housing, and has an upper end portion supported by an upper portion of the light admissible housing, and a lower end portion supported by the light core. The arc tube has a first and a second electrode formed at two ends thereof and electrically connected with the upper end portion of the supporting frame and the light core respectively, wherein sodium vapor in the arc tube is electrically excited to discharge light having an intensity equivalent to that generated by more than 1000 W power.

21 Claims, 5 Drawing Sheets

HIGH PRESSURE SODIUM LAMP

BACKGROUND OF THE PRESENT INVENTION

1. Field of Invention

The present invention relates to a lamp, and more particularly to a high pressure sodium lamp comprising a sodium vapor illumination arrangement which is capable of generating light which has more than 1500 W power.

2. Description of Related Arts

A conventional high pressure sodium lamp usually comprises a threaded head for externally connecting to a power source, a glass housing provided on the threaded head, and an arc tube mounted on the glass housing and filled with a predetermined amount of sodium vapor and/or other gases so that when the threaded head is electrically connected to the external power source, the sodium vapor in the arc tube is excited to generate illumination.

This conventional high pressure sodium lamp has the established advantages of having high efficiency, low energy consumption, enhanced product life span and capable of providing high intensity illumination. Because of these advantages, conventional high pressure sodium lamp has widely been used all over the world. A major disadvantage of the above-mentioned high pressure sodium lamp is that almost all high pressure sodium lamp has less than 1000 W power. As a result, its application is severely limited because many applications require high intensity of illumination which exceeds 1000 W.

One of the major reasons limiting the power of convention high pressure sodium lamp is that when the power of the conventional sodium lamp exceeds 1000 W, the lamp will generate a substantial amount of heat and it will cause overheat problem to the physical components of the high pressure sodium lamp. Moreover, when the power of the sodium lamp is increased, the overall size of which will also be increased and this will present a new limitation on the application of the sodium lamp. For example, when the overall size of the high pressure sodium lamp is too bulky, it may not be suitable to use in particular circumstances even though it can generate a substantial intensity of illumination.

SUMMARY OF THE PRESENT INVENTION

The invention is advantageous in that it provides a high pressure sodium lamp comprising a sodium vapor illumination arrangement which is capable of generating light which has more than 1500 W power without substantial increase in the overall size of the lamp.

Another advantage of the present invention is to provide a high pressure sodium lamp comprising a sodium vapor illumination arrangement a sodium vapor illumination arrangement which comprises an arc tube moveably mounted between a supporting frame and a light core so as to provide adequate tolerance for the arc tube when it is subject to a substantial amount of heat. In other words, when the power of the high pressure sodium lamp reaches 1500 W, the arc tube will not be damaged by physical expansion resulting from the substantial heat because adequate tolerance for slight change of physical size of the arc tube within the light admissible housing is allowed. This slight change of physical size minimally affects other components of the sodium lamp.

Another advantage of the present invention is to provide a high pressure sodium lamp comprising a sodium vapor illumination arrangement which comprises an insulating element provided at the light core so as to prevent heat transfer from the from the arc tube to the light core.

Another advantage of the present invention is to provide a high pressure sodium lamp comprising a sodium vapor illumination arrangement comprising a gas absorbing element for absorbing gas residual within the light admissible housing so as to minimize oxidation of the various physical components within the light admissible housing.

Another advantage of the present invention is to provide a high pressure sodium lamp comprising a sodium vapor illumination arrangement which comprises a supporting frame having an enhanced stress distribution structure so as to maximize the life span of the supporting frame.

Additional advantages and features of the invention will become apparent from the description which follows, and may be realized by means of the instrumentalities and combinations particular point out in the appended claims.

According to the present invention, the foregoing and other objects and advantages are attained by providing a high pressure sodium lamp, comprising:

a lamp base for electrically connecting to an external AC power source; and a light admissible housing provided on the lamp base and defines a lamp cavity within the light admissible housing; and a sodium vapor illumination arrangement, which comprises:

a light core extended from the lamp base into the light admissible housing;

a supporting frame longitudinally extended in the light admissible housing, wherein the supporting frame has an upper end portion supported by an upper portion of the light admissible housing, and a lower end portion supported by the light core;

an arc tube which is made by aluminum oxide ceramic, and has a first and a second electrode formed at two ends thereof and electrically connected with the upper end portion of the supporting frame and the light core respectively, wherein the arc tube is filled with sodium vapor such that when the lamp base is electrically connected with an external AC power source, the sodium vapor in the arc tube is electrically excited to discharge light having an intensity equivalent to that generated by 1500 W power.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Referring to FIG. 1 to FIG. 5 of the drawings, a high pressure sodium lamp according to a preferred embodiment of the present invention is illustrated, in which the high pressure sodium lamp comprises a lamp base 10, a light admissible housing 20, and a sodium vapor illumination arrangement 30.

Figure 1:
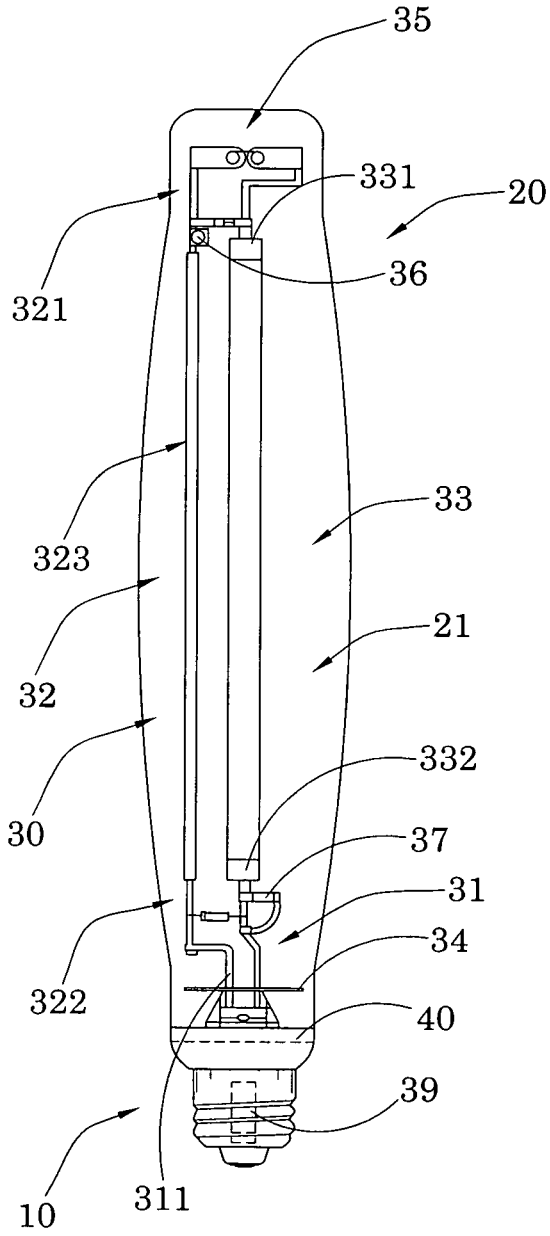
FIG. 1 is a side view of a high pressure sodium lamp according to a preferred embodiment of the present invention.
Figure 2:
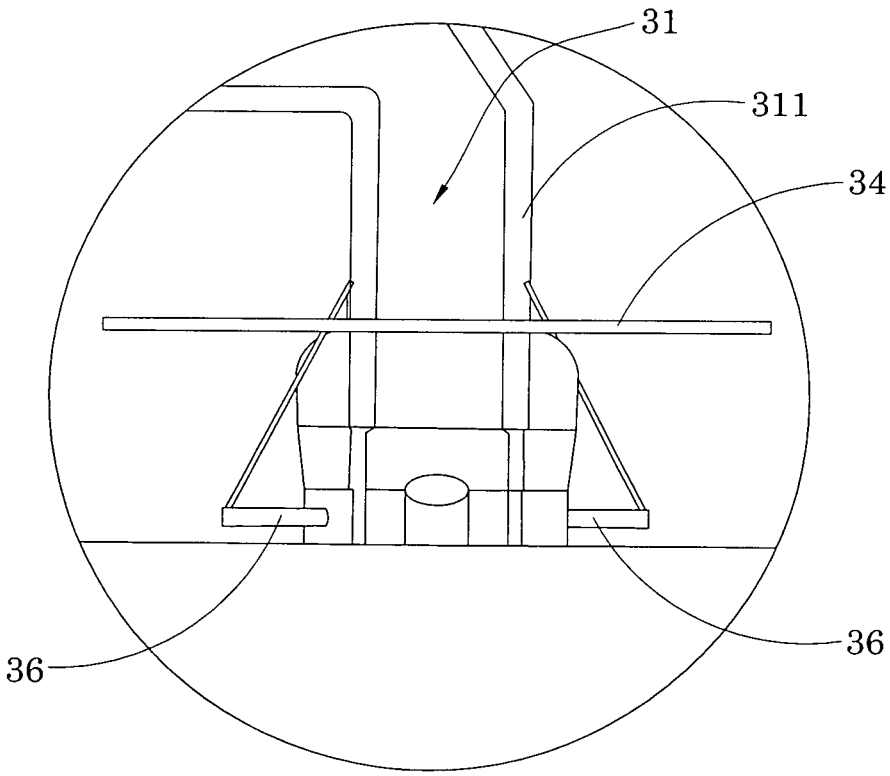
FIG. 2 is schematic diagram of the high pressure sodium lamp according to the above preferred embodiment of the present invention.
Figure 3:
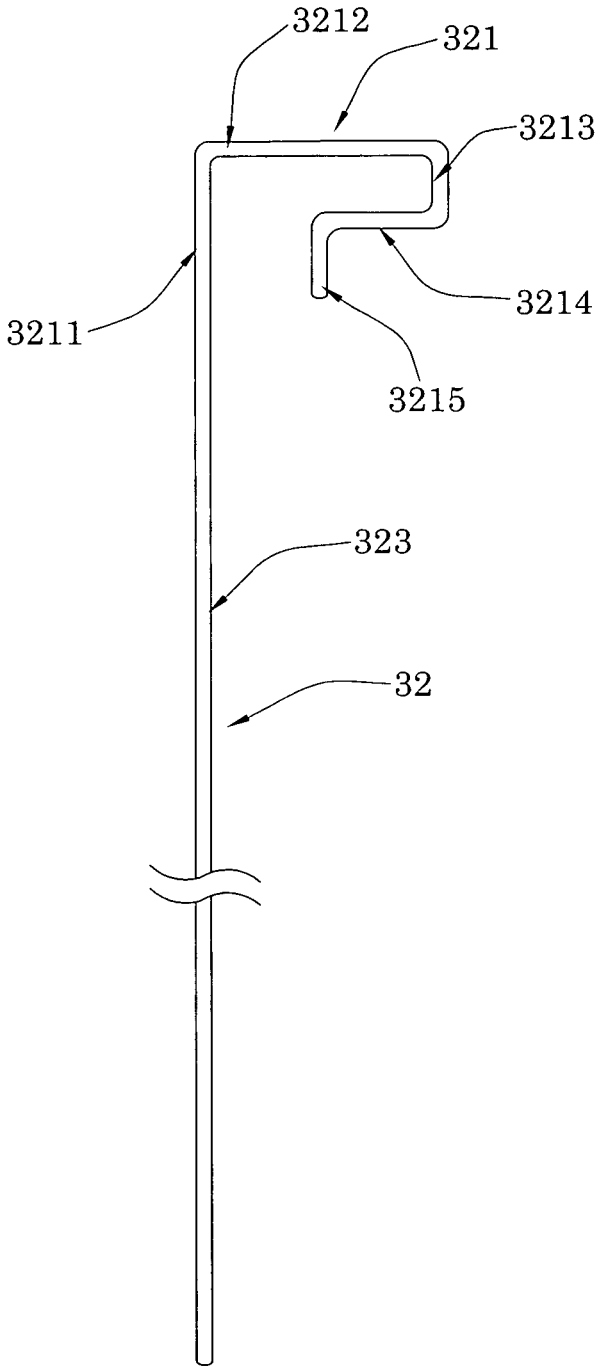
FIG. 3 is a schematic diagram of the supporting frame of the high pressure sodium lamp according to the above preferred embodiment of the present invention.
Figure 4:
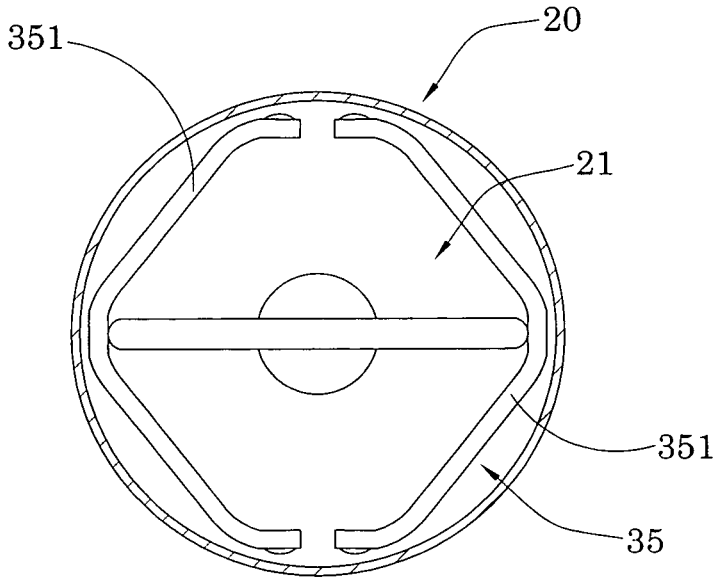
FIG. 4 is a schematic diagram of a resilient mount of the high pressure sodium lamp according to the above preferred embodiment of the present invention.

As shown in FIG. 1 of the drawings, the lamp base 10 is for electrically connecting to an external AC power source, and is threaded to allow a user to connect the high pressure sodium lamp to an external light socket.

The light admissible housing 20 is provided on the lamp base 10 and defines a lamp cavity 21 within the light admissible housing 20.

The sodium vapor illumination arrangement 30 comprises a light core 31, a supporting frame 32 and an arc tube 33 provided within the lamp cavity of the light admissible housing 20. On the other hand, the light core 31 extends from the lamp base 10 into the light admissible housing 20 and provides electricity connection from the lamp base 10 to the arc tube 33.

The supporting frame 32 longitudinally extends in the light admissible housing 10, wherein the supporting frame 32 has an upper end portion 321 supported by an upper portion of the light admissible housing 10, and a lower end portion 322 supported by the light core 31. The supporting frame 32 further has an elongated main portion 323 extended between the upper end portion 321 and the lower end portion 322.

The arc tube 33 is made by aluminum oxide ceramic, and has a first and a second electrode 331, 332 formed at two ends thereof and electrically connected with the upper end portion 321 of the supporting frame 32 and the light core 31 respectively (preferably through a conductive element 37), wherein the arc tube 33 is filled with sodium vapor such that when the lamp base 10 is electrically connected with an external AC power source, the sodium vapor in the arc tube 33 is electrically excited to discharge light having an intensity equivalent to that generated by more than 1000 W power.

According to the preferred embodiment of the present invention, the lamp base 10 is made of conductive material and is threaded to rotatably connect with a light socket. The conductive material is used for conducting electricity from an external AC power source to the sodium vapor illumination arrangement 30.

The light admissible housing 20 is preferably made of glass material so that it is transparent to allow light to pass through an outer wall of the light admissible housing 20, and is rigid enough to sustain physical impact. As shown in FIG. 1 of the drawings, the light admissible housing 20 is elongated in shape and has a circular cross section, wherein a width of a mid portion of the light admissible housing 20 is greater than a width of both an upper and a lower portion of the light admissible housing 20.

The sodium vapor illumination arrangement 30 further comprises a partitioning member 40 provided between the lamp base 10 and the light admissible housing 20 to physically partition the light admissible housing 20 and the lamp base 10. In other words, the lamp cavity 21 is bounded by an exterior wall 22 of the light admissible housing 20 and an upper surface 41 of the partitioning member 40.

The light core 31 of the sodium vapor illumination arrangement 30 comprises a pair of core members 311 upwardly and spacedly extended from the partitioning member 40 to electrically connect with the supporting frame 32 and the arc tube 33.

Moreover, the sodium vapor illumination arrangement 30 further comprises an insulating element 34 provided at the light core 31 to prevent heat transfer between the light core 31 and the arc tube 33. More specifically, the insulating element 34 is transversely mounted at the light core 31 to prevent heat from being transferred from the arc tube 33 to the light core 31 and the lamp base 10. This substantially minimizes overheat problem at the lamp base 10 and the light core 31 so as to avoid damage to those components by excessive heat which is generated when the arc tube 33 is activated to generate illumination.

The arc tube 33 is elongated in shape and is longitudinally mounted within the lamp cavity 21 of the light admissible housing 20. It is important to mention that the connection between the first electrode 331 and the upper end portion 321 of the supporting frame 32 and the connection between the second electrode 332 and the light core 31 are made moveable so as to allow slight movement of the arc tube 33. This feature is important because when the arc tube 33 is operating, a substantial amount of heat will be generated and the arc tube 33 will slightly expand due to the substantial heat. If the connection between the arc tube 33 and other components of the sodium vapor illumination arrangement 30 is rigid and does not allow tolerances, the arc tube 33 will easily break due to a substantial amount of force generated within the arc tube 33 as a resulting of the heat.

Since there exist tolerances for the arc tube 33 to slightly expand within the lamp cavity 21, and the insulating element 34 is utilized for preventing heat from damaging the light core 31 and the lamp base 10, the arc tube 33 can be activated to generate illumination which exceeds 1000 W power.

Figure 5:
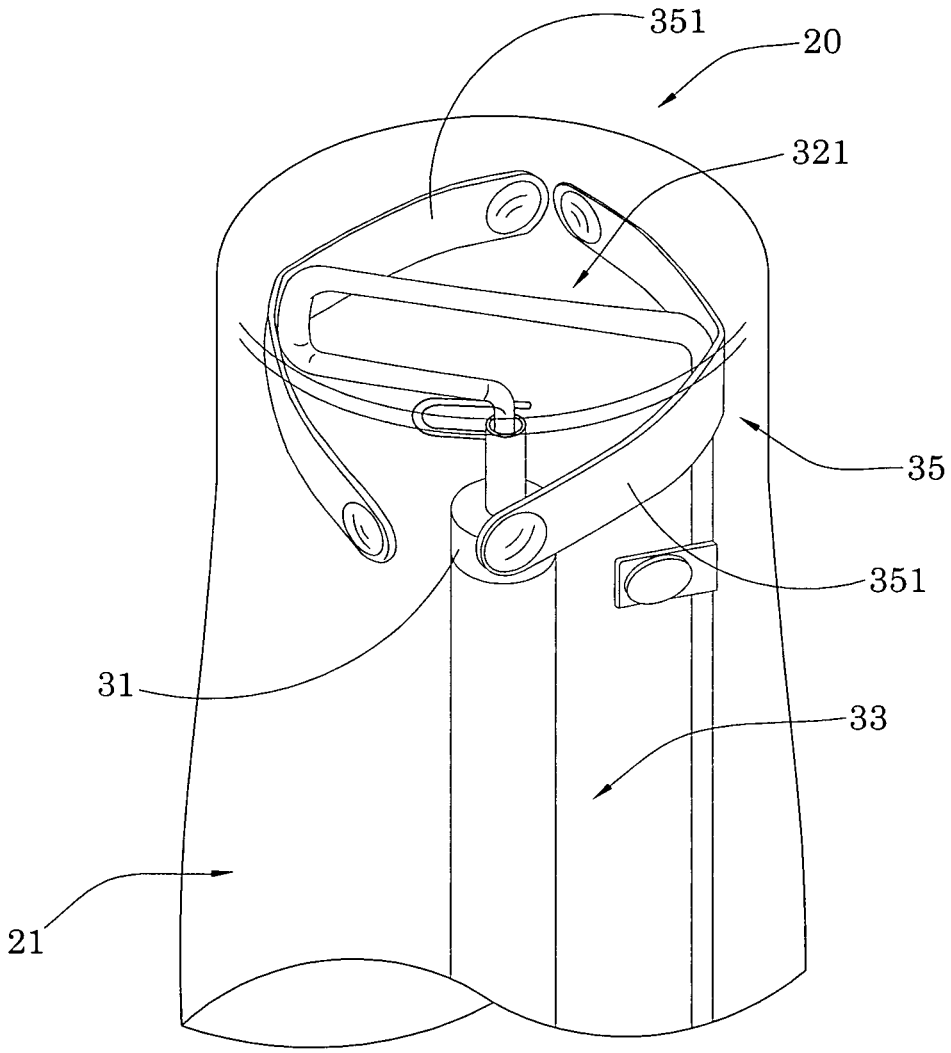
FIG. 5 is a perspective view of the high pressure sodium lamp according to the above preferred embodiment of the present invention.

The sodium vapor illumination arrangement 30 further comprises a resilient mount 35 provided within the lamp cavity 21 for movably and resiliently mounting the supporting frame 32 with the light admissible housing 20. As shown in FIG. 5 of the drawings, the resilient mount 35 comprises a plurality of resilient members 351 resiliently and moveably mounting the upper end portion 321 of the supporting frame 32 with the inner surface of the exterior wall 22 of the light admissible housing 20. This mounting configuration allows the supporting frame 32 to slight move within the lamp cavity 21 so that when the arc tube 33 is operated to generate high-power illumination, the supporting frame 32, which will be heated to a substantial temperature, is provided with adequate movement toleration to minimize internal stress due to heat expansion. The result is that the supporting frame 32 is less likely to be damaged by substantial heat generated by producing high-power illumination. In other words, the supporting frame has an enhanced stress distribution structure provided by the resilient mount 35 so as to maximize the life span of the supporting frame 32 as well as the entire high pressure sodium lamp, even operated with power more than 1000 W. Furthermore, each of the resilient members 351 has "V" cross sectional shape for providing the resilient movement for the supporting frame 32. In other words, each of the resilient members 351 has V-shaped cross section wherein the upper end portion 321 of the supporting frame 32 is arranged to bias against mid portions 352 of the resilient members 351 which normally apply an urging force toward the upper end portion 321 of the supporting frame 32.

The sodium vapor illumination arrangement 30 further comprises a plurality of gas absorbing elements 36 for absorbing gas residual within the light admissible housing 20 so as to minimize oxidation of the various physical components within the light admissible housing 20. According to the preferred embodiment of the present invention, the gas absorbing elements 36 are mounted on the supporting frame 32 and the light core 31 for absorbing the gas residuals.

As mentioned above, the supporting frame 32 has the upper end portion 321, a lower end portion 322 and the elongated main portion 323 extended between the upper end portion 321 and the lower end portion 322. The supporting frame 32 further comprises a quartz tube 324 mounted in the lamp cavity 21 to embed the elongated main portion 323 of the supporting frame 32 for protection thereof. Moreover, the supporting frame 32 is preferably made by stainless steel having approximately 2.5 mm diameter.

The upper end portion 321 of the supporting frame 32 is transversely extended from the top end of the elongated main portion 321 and is bent to form an opened rectangular loop approximately resembling the shape of "R". In other words, the upper end portion 321 of the supporting frame 32 is divided into five sections 3211, 3212, 3213, 3214, 3215 wherein the first section 3211 is upwardly and integrally extended from a top end of the elongated main section 323, the second section 3212 is transversely extended from the top end of the first section 3211, the third section 3213 is downwardly extended from an outer end of the second section 3212, the fourth section 3214 is inwardly and transversely extended from the lowest end of the third section 3213, and the fifth section 3215 is downwardly extended from the inner end of the fourth section 3214. These first through fifth sections 3211, 3212, 3213, 3214, 3215 form the above mentioned approximate "R" shape of the upper end portion 321 of the supporting frame 32.

The sodium vapor illumination arrangement 30 further comprises an inductive ballast 39 mounted at the lamp base 10 for electrically connected between the external AC power source and the arc tube 33, wherein the inductive ballast 39 is arranged to control the current supplied to the arc tube 33 for ensuring a stable operation thereof. Moreover, the inductive ballast is arranged to ignite the arc tube 33 at high frequency by providing a voltage spike. In this preferred embodiment, the inductive ballast 39 is arranged is arranged to have an output frequency at around 50 kHz so as to minimize the current required by the arc tube 33, and allow the sodium vapor illumination arrangement 30 to provide illumination of more than 1000 W power (preferably 1500 W).

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A high pressure sodium lamp, comprising:

a lamp base for electrically connecting to an external AC power source; and a light admissible housing provided on said lamp base and defines a lamp cavity within said light admissible housing; and a sodium vapor illumination arrangement, which comprises:

a light core extended from said lamp base into said light admissible housing;

a supporting frame longitudinally extended in said light admissible housing, wherein said supporting frame has an upper end portion supported by an upper portion of said light admissible housing, and a lower end portion supported by said light core; and an arc tube which is made by aluminum oxide ceramic, and has a first and a second electrode formed at two ends thereof and electrically connected with said upper end portion of said supporting frame and said light core respectively, wherein said arc tube is filled with sodium vapor such that when said lamp base is electrically connected with an external AC power source, said sodium vapor in said arc tube is electrically excited to discharge light having an intensity equivalent to that generated by more than 1000 W power.

2. The high pressure sodium lamp, as recited in claim 1, wherein said sodium vapor illumination arrangement further comprises a partitioning member provided between said lamp base and said light admissible housing to physically partition said light admissible housing and said lamp base, while said light core of said sodium vapor illumination arrangement comprises a pair of core members upwardly and spacedly extended from said partitioning member to electrically connect with said supporting frame and said arc tube.

3. The high pressure sodium lamp, as recited in claim 1, wherein said sodium vapor illumination arrangement further comprises an insulating element provided in said light admissible housing at said light core to prevent heat transfer between said light core and said arc tube.

4. The high pressure sodium lamp, as recited in claim 2, wherein said sodium vapor illumination arrangement further comprises an insulating element provided in said light admissible housing at said light core to prevent heat transfer between said light core and said arc tube.

5. The high pressure sodium lamp, as recited in claim 1, wherein said arc tube is elongated in shape and is longitudinally mounted within said lamp cavity of said light admissible housing, wherein said connection between said first electrode and said upper end portion of said supporting frame and said connection between said second electrode and said light core are slightly made moveable so as to allow slight movement of said arc tube to substantially relieve stress developed in said arc tube when said arc tube is subject to high temperature.

6. The high pressure sodium lamp, as recited in claim 2, wherein said arc tube is elongated in shape and is longitudinally mounted within said lamp cavity of said light admissible housing, wherein said connection between said first electrode and said upper end portion of said supporting frame and said connection between said second electrode and said light core are slightly made moveable so as to allow slight movement of said arc tube to substantially relieve stress developed in said arc tube when said arc tube is subject to high temperature.

7. The high pressure sodium lamp, as recited in claim 4, wherein said arc tube is elongated in shape and is longitudinally mounted within said lamp cavity of said light admissible housing, wherein said connection between said first electrode and said upper end portion of said supporting frame and said connection between said second electrode and said light core are slightly made moveable so as to allow slight movement of said arc tube to substantially relieve stress developed in said arc tube when said arc tube is subject to high temperature.

8. The high pressure sodium lamp, as recited in claim 5, wherein said sodium vapor illumination arrangement further comprises a resilient mount provided within said lamp cavity for movably and resiliently mounting said supporting frame with said light admissible housing, wherein said resilient mount comprises a plurality of resilient members resiliently and moveably mounting said upper end portion of said supporting frame with an inner surface of an exterior wall of said light admissible housing.

9. The high pressure sodium lamp, as recited in claim 6, wherein said sodium vapor illumination arrangement further comprises a resilient mount provided within said lamp cavity for movably and resiliently mounting said supporting frame with said light admissible housing, wherein said resilient mount comprises a plurality of resilient members resiliently and moveably mounting said upper end portion of said supporting frame with an inner surface of an exterior wall of said light admissible housing.

10. The high pressure sodium lamp, as recited in claim 7, wherein said sodium vapor illumination arrangement further comprises a resilient mount provided within said lamp cavity for movably and resiliently mounting said supporting frame with said light admissible housing, wherein said resilient mount comprises a plurality of resilient members resiliently and moveably mounting said upper end portion of said supporting frame with an inner surface of an exterior wall of said light admissible housing.

11. The high pressure sodium lamp, as recited in claim 8, wherein each of said resilient members has V-shaped cross section wherein said upper end portion of said supporting frame is arranged to bias against mid portions of said resilient members which normally apply an urging force toward said upper end portion of said supporting frame.

12. The high pressure sodium lamp, as recited in claim 9, wherein each of said resilient members has V-shaped cross section wherein said upper end portion of said supporting frame is arranged to bias against mid portions of said resilient members which normally apply an urging force toward said upper end portion of said supporting frame.

13. The high pressure sodium lamp, as recited in claim 10, wherein each of said resilient members has V-shaped cross section wherein said upper end portion of said supporting frame is arranged to bias against mid portions of said resilient members which normally apply an urging force toward said upper end portion of said supporting frame.

14. The high pressure sodium lamp, as recited in claim 7, wherein said supporting frame further comprises a quartz tube mounted in said lamp cavity to embed said elongated main portion of said supporting frame for protection thereof.

15. The high pressure sodium lamp, as recited in claim 12, wherein said supporting frame further comprises a quartz tube mounted in said lamp cavity to embed said elongated main portion of said supporting frame for protection thereof.

16. The high pressure sodium lamp, as recited in claim 13, wherein said upper end portion of said supporting frame is divided into five sections, wherein said first section is upwardly and integrally extended from a top end of said elongated main section, wherein said second section is transversely extended from said top end of said first section, wherein said third section is downwardly extended from an outer end of said second section, wherein said fourth section is inwardly and transversely extended from a lowest end of said third section, wherein and said fifth section is downwardly extended from said inner end of said fourth section.

17. The high pressure sodium lamp, as recited in claim 15, wherein said upper end portion of said supporting frame is divided into five sections, wherein said first section is upwardly and integrally extended from a top end of said elongated main section, wherein said second section is transversely extended from said top end of said first section, wherein said third section is downwardly extended from an outer end of said second section, wherein said fourth section is inwardly and transversely extended from a lowest end of said third section, wherein and said fifth section is downwardly extended from said inner end of said fourth section.

18. The high pressure sodium lamp, as recited in claim 13, wherein said sodium vapor illumination arrangement further comprises an inductive ballast mounted at said lamp base for electrically connected between said external AC power source and said arc tube, wherein said inductive ballast is arranged to control a current supplied to said arc tube for ensuring a stable operation thereof, and to ignite said arc tube at high frequency, wherein said inductive ballast is arranged to have an output frequency at around 50 kHz.

19. The high pressure sodium lamp, as recited in claim 17, wherein said sodium vapor illumination arrangement further comprises an inductive ballast mounted at said lamp base for electrically connected between said external AC power source and said arc tube, wherein said inductive ballast is arranged to control a current supplied to said arc tube for ensuring a stable operation thereof, and to ignite said arc tube at high frequency, wherein said inductive ballast is arranged to have an output frequency at around 50 kHz.

20. The high pressure sodium lamp, as recited in claim 7, wherein said sodium vapor illumination arrangement further comprises a plurality of gas absorbing elements for absorbing gas residual within said light admissible housing so as to minimize oxidation of said various physical components within said light admissible housing.

21. The high pressure sodium lamp, as recited in claim 19, wherein said sodium vapor illumination arrangement further comprises a plurality of gas absorbing elements for absorbing gas residual within said light admissible housing so as to minimize oxidation of said various physical components within said light admissible housing.

* * * * *